United States Patent [19]

Bemisderfer et al.

[11] Patent Number: 5,062,475

[45] Date of Patent: Nov. 5, 1991

[54] CHEVRON LANCED FIN DESIGN WITH UNEQUAL LEG LENGTHS FOR A HEAT EXCHANGER

[75] Inventors: Charles H. Bemisderfer, Granger, Ind.; James A. Wanner, Rockford, Ill.

[73] Assignee: Sundstrand Heat Transfer, Inc., Dowagiac, Mich.

[21] Appl. No.: 415,950

[22] Filed: Oct. 2, 1989

[51] Int. Cl.[5] ..... F28D 1/04

[52] U.S. Cl. ..... 165/151; 165/181

[58] Field of Search ..... 165/151, 181, 182, 152

[56] References Cited

U.S. PATENT DOCUMENTS

| | | | |
|---|---|---|---|
| 3,265,127 | 8/1966 | Nickol et al. . | |
| 3,810,509 | 5/1974 | Kun . | |
| 3,916,989 | 11/1975 | Harada et al. . | |
| 4,300,629 | 11/1981 | Hatada et al. | 165/151 |
| 4,365,667 | 12/1982 | Hatada et al. . | |
| 4,434,844 | 3/1984 | Sakitani et al. . | |
| 4,469,167 | 9/1984 | Itoh et al. | 165/151 |
| 4,480,684 | 11/1984 | Onishi et al. . | |
| 4,550,776 | 11/1985 | Lu . | |
| 4,614,230 | 9/1986 | Sakuma et al. | 165/151 |
| 4,691,768 | 9/1987 | Obosu | 165/151 |
| 4,705,105 | 11/1987 | Cur | 165/151 |
| 4,723,599 | 2/1988 | Hanson . | |
| 4,791,984 | 12/1988 | Hatada et al. | 165/151 |

FOREIGN PATENT DOCUMENTS

| | | | |
|---|---|---|---|
| 0184944 | 6/1986 | European Pat. Off. | 165/151 |
| 2449145 | 4/1976 | Fed. Rep. of Germany | 165/151 |
| 0037696 | 3/1982 | Japan | 165/151 |
| 0268986 | 11/1986 | Japan | 165/151 |
| 0056788 | 3/1987 | Japan | 165/152 |
| 0252899 | 10/1989 | Japan | 165/182 |
| 2023798 | 7/1980 | United Kingdom | 165/151 |
| 2042708 | 9/1980 | United Kingdom | 165/151 |
| 2125529 | 3/1984 | United Kingdom | 165/151 |
| 0020094 | 2/1985 | United Kingdom | 165/151 |

*Primary Examiner*—John Ford

*Attorney, Agent, or Firm*—James A. Wanner

[57] ABSTRACT

The invention relates to an improved fin and tube type heat exchanger wherein thin, heat-conducting fins act as a secondary heat-exchange surface for a heat-conducting medium flowing through the tubes. The thin fin plates substantially lie in a plane perpendicular to the air flow and have angled louvers formed therein. The angled louvers have a short leg and a long leg, with the short leg preferably in the fin plane with the long leg bent therefrom. The unequal length legs permit a larger condensate gap between the trailing edge of one louver and the leading edge of the next louver. With the combination of an angled louver plus the short leg lying in the fin plane, a substantially strong fin is provided even with a thin fin plate. The combination of the short leg lying in the direction of air flow, with the longer leg being inclined thereto, allows a high heat transfer coefficient at the leading edge, while the angled portion behind the leading edge generates a turbulent flow to reduce boundary layer growth. The proper orientation of the angled louvers provides a symmetrical fin which simplifies the construction operations and air flow orientation use and permits equal sized large gaps between the trailing edges and leading edges of the louvers.

13 Claims, 1 Drawing Sheet

CHEVRON LANCED FIN DESIGN WITH UNEQUAL LEG LENGTHS FOR A HEAT EXCHANGER

FIELD OF THE INVENTION

The fin design of the present invention is useful in the field of tube and fin heat exchange units wherein the fins are of the thin heat conductive plate type with louvered sections struck therefrom. The improved fin design not only increases heat transfer effectiveness but is particularly useful where the cooling of air flow across the heat exchanger forms a condensate, or where it is desirable to have reverse orientation of the heat exchanger coil in the air flow.

BACKGROUND OF THE INVENTION

A typical fin and tube type heat exchanger construction consists of a heat exchanger core having multiple tubes, or multiple rows of tubes, conveying a first heat exchange medium such as a refrigerant, with the tubes normally being perpendicular to the flow of a second heat exchange medium such as air. The rows of tubes pass through multiple substantially parallel fins which are formed of thin plates of heat conducting material such as aluminum. The plates generally lie in planes substantially parallel to the air flow. The fin plates may be flat or of corrugated form so that some convolution portions of the plates are slightly inclined in a first direction to the air flow, and other convolution portions of the plates are slightly inclined in the opposite direction of the air flow.

In the fin and tube type heat exchanger, the first heat exchange fluid flowing inside the tubes is used to heat or cool a second heat exchange fluid passing over fins external of the tubes. In the type of heat exchanger contemplated herein, the second heat exchange fluid is a gaseous medium and is normally air, so the term "air side" is used herein refer to the heat exchange between the fins and the second heat exchange fluid passing thereover. The term "air" is intended to include both atmospheric air and other gaseous fluids acting as the second heat exchange medium. For a fin and tube heat exchanger, the overall heat transfer is largely controlled by the air side heat transfer coefficient and amount of effective air side heat transfer area. The air side heat transfer coefficient is largely controlled by the boundary layer growth along the fin.

When air flows across the fin surface area, the frictional force at the fin-to-air interface causes a thin layer of stagnant air to develop at the leading edge of the fin, and this stagnant air layer grows in thickness in the direction of air flow. This boundary layer has an insulating effect. The thicker the boundary layer, the more it insulates the fin and inhibits heat transfer to or from the fin. The heat transfer coefficient at the leading edge of a flat surface parallel to the air flow is very large but rapidly decreases with distance along the fin in the air flow direction as the boundary layer thickens.

The heat transfer coefficient at the leading edge of a flat surface inclined to the air flow is less than the heat transfer coefficient at the leading edge of a flat surface parallel to the air flow but does not decrease as quickly in the direction of air flow since the inclined flat surface accelerates the air flow overcoming the frictional forces which cause the increasing boundary layer on the surface of the fin. However, an inclined surface, or a combination of inclined surfaces, acts like a blunt object in the path of the air flow and also develops a wake area behind the object. Within the wake area, the heat transfer is significantly reduced due to the lack of fluid motion.

This latter-mentioned characteristic also greatly affects the heat transfer coefficient of fin surface area upstream of a tube in the air flow direction as opposed to an equal fin surface area downstream of the tube in the air flow direction, since the latter is in a stagnant air flow zone. For purposes of the present invention, a distinction is made between a leading fin area upstream of a particular tube and a trailing fin area downstream of the tube in the air flow direction. Of course it is recognized that when there are multiple rows of tubes, the fin material between adjacent tube rows is first a trailing fin area behind the first tube row and a leading fin area in front of the second tube row when considered in the air flow direction, and such terms are used herein for this concept.

When there are combinations of fin surface areas with the intent of having air flow pass therebetween, the near proximity of such fin areas, such as the leading edge of one such area and the trailing edge of an adjacent such area, forms a grid upon which condensate can cling. In other words, the surface tension of a condensate from the air flow, when the heat exchanger is used as an evaporator, can bridge small openings and thus divert air flow away from these openings. For purposes herein, the term "condensate gap" is used to refer to the distance between the trailing edge of one fin surface area and the leading edge of an adjacent fin surface area in close proximity thereto. The bridging of condensate across the condensate gap causes channeling of flow which bypasses certain fin surface area and thus reduces the total heat transfer to or from inclined fin surface areas.

In order to increase the air flow turbulence, and thus reduce the boundary layer effect, it is furthermore known to strike louvers from the fin plates. Such louvers on corrugated fins are taught in U.S. Pat. No. 4,434,844, issued Mar. 6, 1984 to Sakitani et al and U.S. Pat. No. 4,469,167, issued Sep. 4, 1984 to Itoh et al, wherein the louvers are flat, or in U.S. Pat. No. 4,300,629, issued Nov. 17, 1981 to Hatada et al, wherein the louvers are chevronshaped with one leg of the louvers lying in the plane of the fin convolution. It is noted that, in the latter reference, the louver leg lengths are equal, which reduces the maximum permissible condensate gap, which acts as a condensate trap between the leading and trailing edges of adjacent fin louvers. U.S. Pat. No. 3,265,127, issued Aug. 9, 1966 to Nickol et al, teaches a flat fin plate, which is not used in the typical tube and fin type construction referred to above, wherein the louvers of unequal leg length with the short leg lying in the plane of the fin plate but not necessarily in the orientation which provides the most effective use thereof or provides symmetry for reversibility of air flow direction while maintaining high utilization of fin effectiveness.

SUMMARY OF THE INVENTION

The present invention is directed to providing a heat exchanger fin with an increased heat transfer coefficient for use in a fin and tube type heat exchanger. The improved fin design has angled louvers formed by slits in the fin plate, with the louvers having a cross-sectional area in the form of a chevron, with one leg of the louver being shorter than the other leg of the louver. If the fin plate is of the corrugated type, it is preferred that the short leg lie in the plane of the fin convolution.

One object of the present invention is to provide a fin plate with louvers formed therein while maximizing the length of the condensate gap between the leading edge of one fin louver and the trailing edge of an adjacent fin louver while at the same time improving the overall heat exchange effectiveness by having a leading edge of the louver in the plane of air flow, with a major portion of the air flow at an angle thereto.

Another object of the present invention is to provide a fin plate surface having louvers therein which provides an increased overall heat transfer coefficient while still maintaining sufficient structural rigidity of the fin plate. In the preferred form, practicing the invention with a corrugated fin plate, the short leg of the louvers lie in the plane of the plate convolutions.

It is still a further object of the present invention to provide a fin plate surface having louvers therein, the louvers having unequal leg lengths, but with the louvers arranged in a symmetrical pattern so as to simplify assembly, not require particular orientation of the heat exchanger core in an air flow path, and provide equal lengths between the trailing edge of one louvered surface and the leading edge of the adjacent louvered surface.

It is another object of the present invention that a leading fin edge surface is provided parallel to the air flow path where angled louvers are formed in a fin plate of corrugation shape.

Still yet another object of the present invention is to provide a heat exchanger fin adapted for use in a fin and tube type heat exchanger comprising tubes conveying a first heat exchange fluid and wherein the tubes pass through a plurality of fin plates with air flow passing over the fin plates being along an air flow axis substantially parallel to the major plane of the fin plates, the fin comprising a thin plate of thermally conductive material having angled louvers formed from the fin plate with the length of the louvers lying substantially perpendicular to the air flow axis and the width of the louvers being along the air flow axis, wherein the louver width has a short leg and a longer leg with at least the longer leg being bent from the plane of the fin plate the fin plate having first areas upstream to the tubes in the direction of air flow and second areas downstream relative to the tubes and the short leg being located in the upstream direction when the louvers are located in the first areas and located in the downstream direction when the louvers are located in the second areas.

A still further object of the present invention is providing a heat exchanger fin adapted for use in a fin and tube type heat exchanger comprising tubes conveying a first heat exchange fluid and wherein the tubes pass through a plurality of fin plates with air flow passing over the fin plates being along an air flow axis substantially parallel to the major plane of the fin plates, the fin comprising a thin plate of thermally conductive material having angled louvers formed from the fin plate with the length of the louvers lying substantially perpendicular to the air flow axis and the width of the louvers being along the air flow axis, wherein the louver width has a short leg and a longer leg with at least one of the longer legs being bent from the plane of the fin plate, the fin plate having first areas upstream to the tubes in the direction of air flow and second areas downstream relative to the tubes and the fin plate being corrugated with convolutions of the plate in the first areas being bent from the air flow axis on a first direction and convolutions of the plate in the second areas being bent from the air flow axis in the opposite direction.

DESCRIPTION OF PREFERRED EMBODIMENTS

Figure 1:
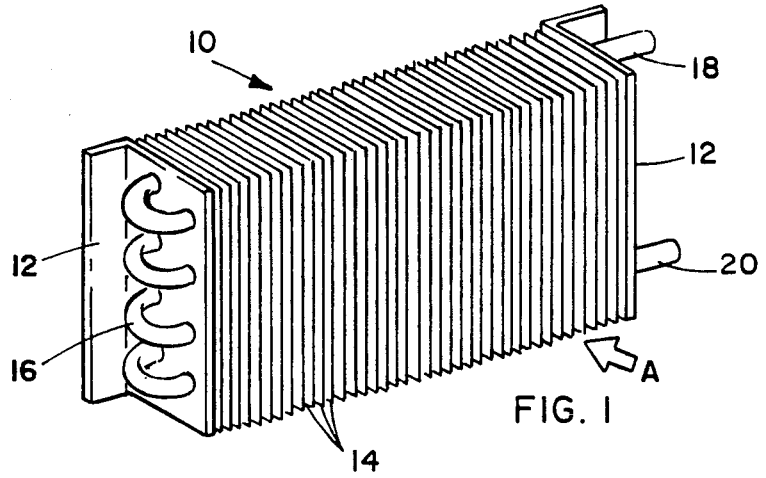
FIG. 1 is a perspective view of a heat exchanger core which embodies the present invention.

A heat exchanger or heat exchanger core 10, incorporating the concepts of the present invention, is shown in FIG. 1. The heat exchanger core 10 has a pair of end plates 12 with a large number of parallel thin fin plates 14 evenly distributed along the length of the core 10 between the end plates 12. In the conventional manner, a plurality of heat exchanger tubes 16 pass longitudinally through the heat exchanger core. By various manufacturing methods well known in the heat exchanger art, the tubes 16 are caused to be in close thermal contact with the fin plates 14. One such manufacturing method is the radial expansion of the tube 16 into fin collars 17 once the tube has been placed within the fin stack of the heat exchanger core 10. The heat transfer tube 16 can be a single tube with an inlet 18 and outlet 20, or it can be a plurality of tubes with return bends joining the tubes at each end of the heat exchanger stack, as is well known in the art.

A heat transfer medium, such as a refrigerant or hot or cold fluid, enters the inlet 18, passes through the tube 16, and exits at the outlet 20. A second heat transfer medium, such as air flow, indicated by Arrow A, passes transversely through the heat exchanger stack and flows over the fins 14 and the tubes 16. The fins 14 act as a secondary heat transfer surface for the tubes 16 and provide the air side heat transfer between the fins and the second heat transfer medium. One typical environment for the fins of the present invention, but by no means the only environment, is the evaporator coil of a refrigerant or air conditioning system wherein the tubes 16 are thin-wall copper tubes, and the fin plates 14 are thin aluminum plates formed of aluminum sheet and evenly spaced at 5 to 20 fins per linear inch of the heat exchanger stack.

Figure 2:
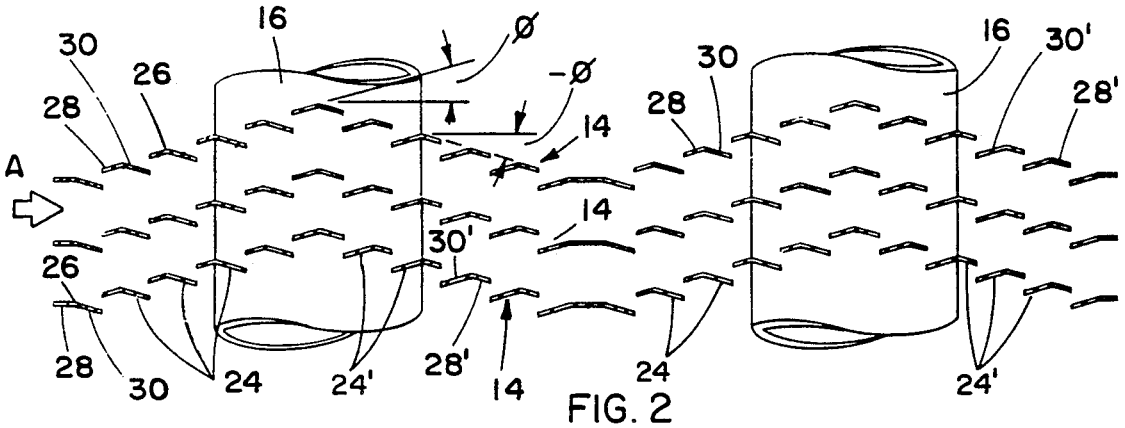
FIG. 2 is an enlarged sectional view taken along lines 2—2 of FIG. 4, showing portions of a pair of tubes and their relationship to the cross section of three fin plates embodying the concepts of the present invention.
Figure 4:
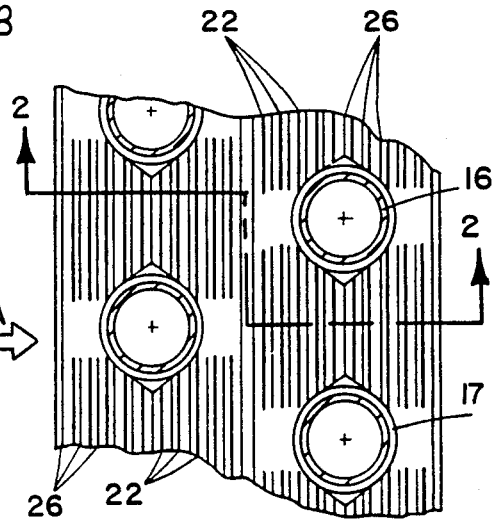
FIG. 4 is a plan view of a portion of one of the fin plates incorporating the concepts of the present invention and used in the heat exchanger of FIG. 1.

FIGS. 2 and 4 show two views of the tube 16 and fin 14 detail. In FIG. 2 only three fin plates 14, each consisting of multiple louvers, are depicted for clarity reasons, although it is understood in practice that a fin plate stack constitutes many such fins. In the preferred form each fin is formed into an overall corrugated shape so that its flat surfaces are at an angle to the inlet air flow direction depicted by Arrow A and preferably form one chevron-shaped convolution per tube row. As depicted two tube rows are shown, although some heat exchanger cores may have a single tube row, and most heat exchanger cores have multiple tube rows. In the two tube row fin stacks shown in FIG. 2, the convolutions are shown to be inclined from a horizontal air flow direction, although the latter of course depends upon the orientation of the heat exchanger core and the air flow therethrough. Normally, the primary plane of the fin plate is in a plane parallel to the primary air flow axis A, however, the fin plate convolutions are slightly inclined to such axis.

It is also noted that a distinction is made herein between the inclination of the fin plate convolutions, depicted by angles $\theta$ and $-\theta$, and the inclination of legs of individual louvers formed in the corrugated fin plate as discussed below. The inclination of the convolutions accelerates the air flow to reduce the buildup of boundary layer thickness. However, large inclinations generate disproportionate increases in pressure drop for a given increase in heat transfer. An inclination angle between 10° and 20° has been found to provide an optimum useful range.

In the preferred form, the fin plate convolution in a first area upstream of the tubes is inclined at the angle $\theta$, that is from the leading edge of the fin to the center of the first tube row and the next convolution in a second area downstream of the tube is inclined at the angle $-\theta$, that is from the center of the first tube row to the center of the fin, at which time the fin convolutions are repeated for the second tube row. While the angles $\theta$ and $-\theta$ need not be equal in the absolute sense, in practice one fin found to provide excellent results has both the positive and negative inclination at the same angle, such angle being $\theta=16°$. While the air flow A initially approaches the thin plate stack horizontally, in the example given, the air flow tends to flow through the fin stack following the gentle fin plate convolutions at the angles $\theta$ and $-\theta$. This tends to increase the velocity of the air flow to reduce boundary layer effects as discussed above.

The corrugated fin plate is further lanced with multiple slits such as 22, depicted by heavy lines in FIG. 4. This forms multiple louvers 24 extending across the fin plate 14 with the length of the louvers perpendicular to the air flow and the width of the louvers lying in the direction of air flow. Each of the louvers formed by the multiple slits 22 is bent about a bend line 26 designated by light lines in FIG. 4. The bend line 26 forms an angled louver, and the bend line is unequally positioned between the leading edge and the trailing edge of the louver in the air flow direction, herein called the width of the louver. Due to the unequal spacing of the bend line between the leading edge and the trailing edge of each louver, each louver is formed with a short leg 28 and a longer leg 30. As the air flows over each angled louver, it is accelerated by the inclined surface and thus reduces the tendency of a thick boundary layer being generated, as would be done by a flat fin. The presence of adjacent louvers forces the air flow down the back side of the louver, which would otherwise create a wake area. As the air moves along the back side of the louver, it is accelerated so that the air can pass through the opening between the trailing edge of the first louver and the leading edge of the next adjacent louver. This also minimizes boundary layer growth along the back side of the louver.

The angled louvers will now be explained in more detail, first looking at the upstream portions of the fin plate, that is the first and third convolutions in the air flow direction of one of the fin plates 14 shown in FIG. 2. In such upstream convolutions, referred to as upstream since it is in the upstream air flow direction relative to each tube row, the short leg 28 is upstream of the longer leg 30. Furthermore, the short leg 28, in the preferred form for manufacturing reasons, lies in the plane of the fin convolution and is thus at the angle $\theta$ relative to the primary air flow direction A. While the shorter leg could be inclined relative to the fin convolution, by not bending the short leg 28 from the fin plate two advantages are obtained. First, greater fin plate strength is obtained since the short louver leg 28 is not bent therefrom. For this reason it has been found preferable that the short leg 28 form at least 20% of the louver width. Secondly, as stated above, the heat transfer coefficient of a flat leading edge parallel to air flow is large, and the short leg being in the plane of the fin convolution should be parallel to the air flow which tends to follow the fin convolutions. This also prevents the leading edge of each louver from forming a blunt object relative to the air flow. It is noted that the short leg 28 of the first angled louver in the air flow direction, that is where the air flow A first enters the fin stack, is parallel to the air flow A and is thus bent from the fin convolution upwardly by the angle $\theta$ at the bend line 26. This is true for the entire length of the fin, so that the entire leading edge of the fin plate is parallel to the incoming air flow.

The longer leg 30 of each louver is bent at the bend line 26 through the angle $\beta$ from the plane of the fin convolution. In the first area upstream of the tubes, this provides an angled louver with the majority of the fin bent from the flat fin surface to increase the air flow velocity to reduce the building of a thick boundary layer. In the preferred example the angle $\beta$ is twice the angle $\theta$ and thus 32° in the embodiment shown. This is partly a matter of convenience for manufacturing reasons, although it is believed that the angle $\beta$ can vary from 10° to 25°. An angled louver is thus formed with a leading edge somewhat parallel to the air flow, but with the majority of the fin being angled from the main plane of the fin plate which reduces adverse boundary layer effects.

Figure 3A:
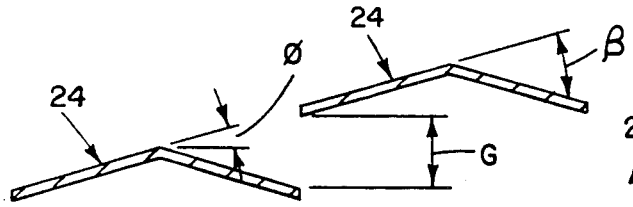
FIG. 3A ( PRIOR ART )
FIG. 3A is a greatly enlarged cross-sectional view of a pair of fin louvers as utilized in the prior art.
Figure 3B:
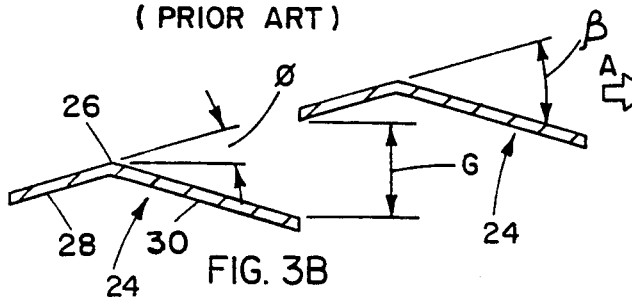
FIG. 3B is a greatly enlarged sectional view of a pair of fin louvers incorporating the concepts of the present invention.

The disproportionate leg width of each angled louver 24 allows for more flow area between adjacent louvers, which would not be the case if the two legs were equal width. This is shown in FIGS. 3A (prior art) and 3B. In both FIGS. 3A and 3B, there is a vertical gap G between the trailing edge of the first louver and the leading edge of the second adjacent louver. For matters of identical comparison, the convolution of the fin plate for both examples is at the angle $\theta$ of 16° from the horizontal air flow direction. Also for both louvers, the trailing edge is bent from the fin plane by the angle $\beta$ which is equal to twice $\theta$ or 32°. By having unequal leg widths as in FIG. 3B, especially with the shorter leg 28 being in the plane of the fin convolution and the longer leg 30 being bent therefrom, the size of the gap G is significantly increased, even though the total louver width is the same, and the angles $\theta$ and $\beta$ are equal for the two designs.

This also provides two advantages. First, more air flows over each trailing leg of each louver rather than bypassing the louver and flowing over the next adjacent louver of the plane convolution. Secondly, by having a larger gap G, it is more difficult for condensate (when the exchanger 10 is used as an evaporator) to bridge the gap G between adjacent louvers. Thus the gap G can be considered a condensate gap, and an enlarged condensate gap makes it more difficult for a condensate bridge to form. This permits more air flow through the gap which may otherwise not be possible with a smaller condensate gap G. The pressure drop across the heat exchanger core 10, with the enlarged gap G, is significantly reduced which encourages an increase in air flow. If a condensate bridge were permitted to form, the air flow also tends to follow the plane of the convolution at angle $\theta$, forming a long planer air flow surface which generates a thick boundary layer.

In second areas downstream of the tubes, that is the second and fourth convolutions of the fin having two tube rows shown in FIG. 2, the short legs of the louvers can still be on the upstream edge of each louver with the longer legs being downstream lying in the plane of the fin plate convolution. However, in the most preferred mode of practicing the invention, the relative positions of the short and longer legs of each louver 24' are reversed, that is with the shorter leg 28' still lying within the plane of the thin convolution but at the trailing edge of the louver, rather than the leading edge of the louver. The longer leg 30' now becomes the leading leg in the downstream areas. While this loses some of the advantages of having a short leg 28' parallel to the direction of air flow as stated above, other advantages are obtained. While it is within the scope of the invention to have the short leg as the leading edge in the second areas downstream of the tubes, the gain in heat flow coefficient is not as critical in these downstream areas due to the wake areas generated by flow around the tubes 16. However, in the preferred embodiment, with the louvers reversed as just described, a symmetrical fin pattern is obtained. Thus the air flow across the fin sees the same louver pattern regardless of whether the air flow is from the left, as shown by Arrow A, or whether the air flow is in the opposite direction or from the right.

This symmetrical louver pattern provides three advantages. First, during the manufacturing or assembly operations, the fin plates can be stacked indiscriminately without care being taken relative to a left flow or a right flow orientation. Secondly, since the heat exchanger core, once manufactured has the same air flow characteristics in both directions, care need not be taken relative to the proper orientation of the heat exchanger core 10 in the air flow A. Thirdly, an equal vertical gap or condensate gap G is maintained since the short leg is always in the plane of the fin convolution and the longer legs bent therefrom.

To provide a specific example of the present invention in its preferred form, one fin design found to provide an increased heat transfer characteristic for the heat exchanger core 10, while also providing an increased condensate gap G, has the following parameters: angle of fin plate convolutions $\theta=16°$; angle of bend of longer leg from fin plate convolution $\beta=32°$; thickness of o aluminum sheet forming the fin plate=0.005" (0.13mm); total surface width of the fin louver=0.056" (1.42mm); width of the short leg=0.022"(0.56mm); width of the longer leg=0.034" (0.86mm); ratio of short leg to total louver width=39%; and vertical gap G=0.019" (0.48mm). When the length of the 15 short leg 28 increases beyond 45% of the total width of the louver, the louver legs approach equal length and thus the gap G is reduced in size. There is also an increased restriction in the amount of air flow passing between adjacent louvers, which stated in a different manner is that there is an increase in bypass of air flow from the gap G. As stated above, the fin loses rigidity when the short leg is less than 20% of the width of the louver, and thus the ratio of the length of the louver short leg to the total width of the louver should be between 20% and 45%. A fin plate built according to the above-stated parameters was tested in comparison to a similar fin plate but with the louver legs of equal length. A significant overall heat transfer increase of 13% was obtained at equal air power which is proportional to inlet air veolcity times overall pressure drop.

It can thus be seen that the present invention as described above meets the objectives providing a fin for a fin and tube type heat exchanger which provides an overall increase in heat transfer effect, increases the gap between adjacent fin louvers, and provides the symmetrical fin pattern simplifying assembly and positioning of the heat exchanger core and the air flow path. Preferred embodiments of the heat exchanger fin as specifically described above are illustrative of the concepts of the present invention but not intended to limit the scope thereof.

We claim:

1. A heat exchanger fin adapted for use in fin and tube type heat exchanger comprising tubes conveying a first heat exchange fluid and wherein said tubes pass through a plurality of fin plates with air flow passing over the fin plates being along an air flow axis substantially parallel to the major plane of the fin plates, said fin comprising:

a thin plate of thermally conductive material having angled louvers formed from said fin plate with the length of said louvers lying substantially perpendicular to said air flow axis and the width of said louvers being along said air flow axis, wherein said louver width consists of a short leg and a longer leg;

said fin plate having first areas upstream in the direction of air flow relative to a first row of said tubes and second areas downstream relative to said first row of said tubes; and said short leg of said louvers being located in the upstream direction when said louvers are located in said first areas and located in the downstream direction when said louvers are located in second areas; and said fin plate being corrugated with convolutions of said plate in said first areas being bent from the air flow axis in a first direction and convolutions of said plate in said second areas being bent from the air flow axis in the opposite direction, said longer leg being bent in an acute angle from the plane of said convolutions and said short leg being in said plane of said convolutions of said fin plate.

2. The fin of claim 1 wherein the width of said short leg is 20% to 45% of the width of said louver.

3. The fin of claim 2 wherein said short leg lies in the plane of said fin plate.

4. The fin of claim 3 wherein said louvers are located on said fin plate in a symmetrical pattern whereby the air flow encounters the same fin louver pattern when the air flow direction is reversed.

5. The fin of claim 1 wherein there are multiple rows of said tubes and said fin plate has first and second areas relative to each row of said tubes.

6. A heat exchanger fin adapted for use in a fin and tube type heat exchanger comprising tubes conveying a first heat exchange fluid and wherein said tubes pass through a plurality of fin plates with air flow passing over the fin plates being along an air flow axis substantially parallel to the major plane of the fin plates, said fin comprising:

a thin plate of thermally conductive material having angled louvers formed from said fin plate with the length of said louvers lying substantially perpendicular to said air flow axis and the width of said louvers being along said air flow axis, wherein said louver width consists of a short leg and a longer leg;

said fin plate having first areas upstream in the direction of air flow relative to a first row of said tubes and second areas downstream relative to said first row of said tubes; and said fin plane being corrugated with convolutions of said plate in said first area being bent from the air flow axis a first direction and convolutions of said plate in said second areas being bent from the air flow axis in the opposite direction, said longer leg being bent in an acute angle from the plane of said convolutions and said short leg being in said plane of said convolutions of said fin plate.

7. The fin of claim 6 wherein said convolutions of said fin in said first areas are bent from the air flow axis by the angle $\theta$ and the convolutions in said second areas are bent from the air flow axis by the angle $-\theta$, and $\theta$ lies in the range of 10° to 20°.

8. The fin of claim 7 wherein said longer legs are bent from the plane of said convolutions by the angle $\beta$, and $\beta=2\theta$.

9. The fin of claim 6 wherein said short leg of said louvers are located in the upstream direction when said louvers are located in said first areas and located in the downstream direction when said louvers are located in said second areas.

10. The fin of claim 9 wherein said louvers are located on said fin plate in a symmetrical pattern whereby the air flow encounters the same fin louver pattern when the air flow direction is reversed.

11. The fin of claim 6 wherein the length of the short leg is 20% to 45% of the length of the louver.

12. The fin of claim 6 wherein the edge of said fin plate is parallel to the air flow axis.

13. The fin of claim 5 wherein there are multiple rows of said tubes and said fin plate has first and second areas relative to each row of said tubes.

* * * * *